US006427368B1

(12) United States Patent
Yang

(10) Patent No.: US 6,427,368 B1
(45) Date of Patent: Aug. 6, 2002

(54) DEVICE THAT WILL ENABLE THE DECORATION ON A MUSIC BOX TO SWAY FRONT AND BACK WHILE IT MOVES UP AND DOWN

(75) Inventor: Shin-Ya Yang, Taipei Hsien (TW)

(73) Assignee: Ya Yung Enterprise Co., LTD, Taipei Hsien (TW)

( * ) Notice: Subject to any disclaimer, the term of this patent is extended or adjusted under 35 U.S.C. 154(b) by 0 days.

(21) Appl. No.: 09/661,011

(22) Filed: Sep. 13, 2000

(51) Int. Cl.[7] ..... G09F 19/02
(52) U.S. Cl. ..... 40/429; 40/414; 84/95.2
(58) Field of Search ..... 40/414, 423, 429, 40/409; 84/95.2

(56) References Cited

U.S. PATENT DOCUMENTS 5,090,144 A * 2/1992 Liu ..... 40/410
5,430,239 A * 7/1995 Chen ..... 84/95.2
5,870,843 A * 2/1999 Hsu et al. ..... 40/411

* cited by examiner

*Primary Examiner*—Cassandra H. Davis
(74) *Attorney, Agent, or Firm*—Pro-Techtor International Services

(57) ABSTRACT

A device that will enable the decoration on a music box to sway front and back while it moves up and down, particularly to a type of device that will enable the decoration on a music box to sway to front and back while it moves up and down. It is mainly composed of a base on which is a first motor that will turn the spring plates of the music wheel to produce music, a gear set that is driven by a second motor, a propping post piercing a ball collar and a ring cover and a top cover; when the second motor drives the gear set and the driving wheel to rotate, the propping post will move up and down in the through hole of the ball collar, and the ball collar will sway to front and back inside the ring collar, so that the movement of the wooden horse will be more realistic.

6 Claims, 7 Drawing Sheets

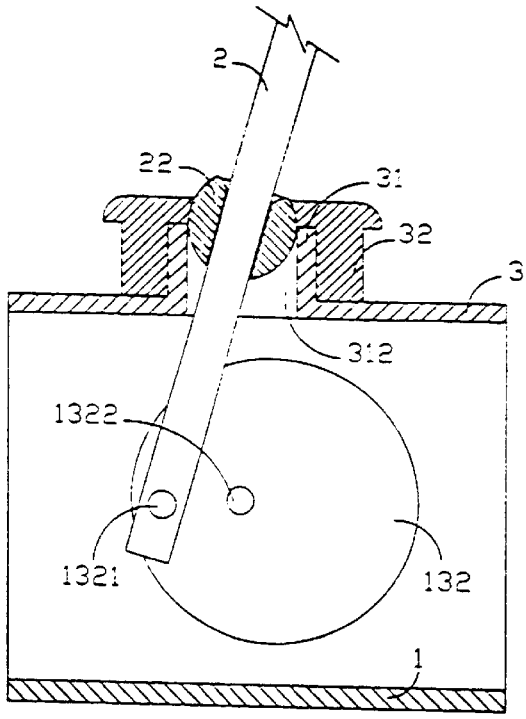
Fig. 3-A
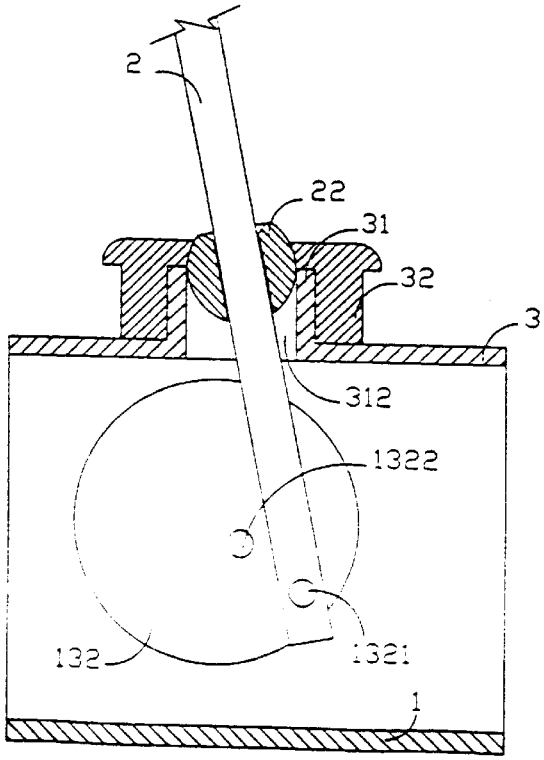
Fig. 3-B

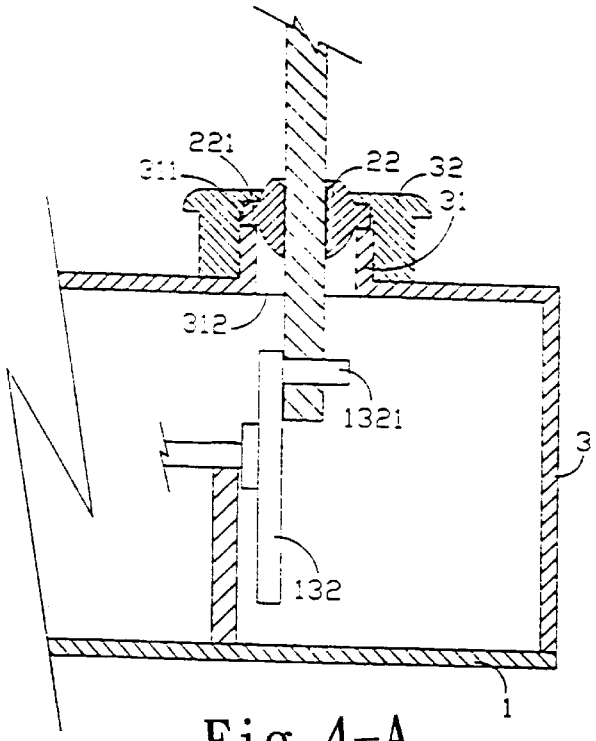
Fig. 4-A
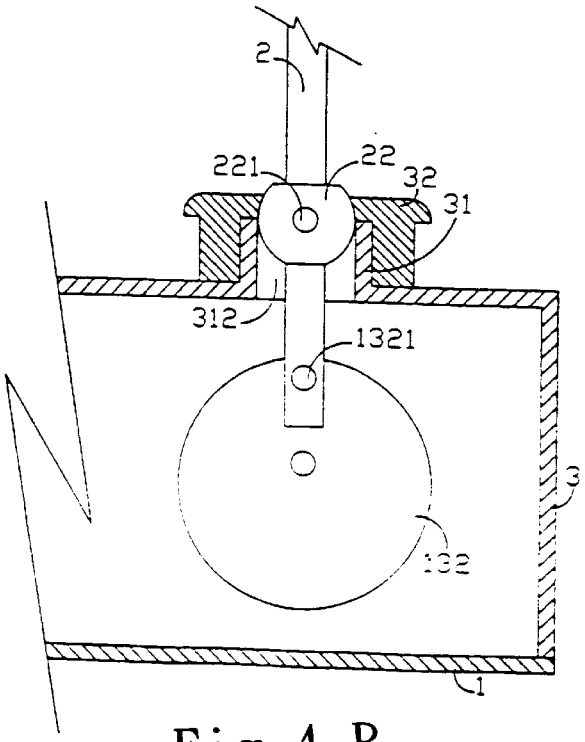
Fig. 4-B

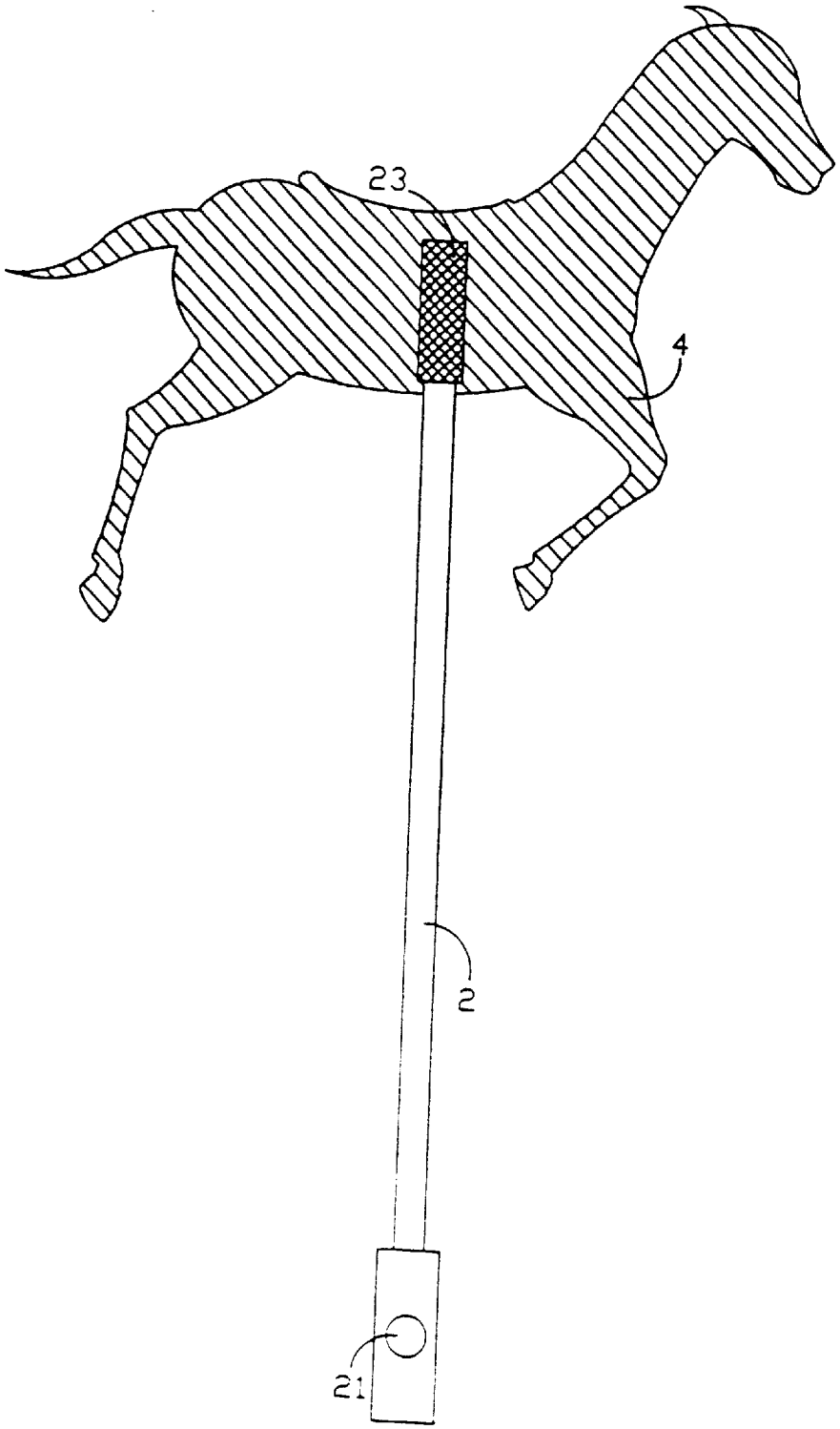
Fig. 6-A

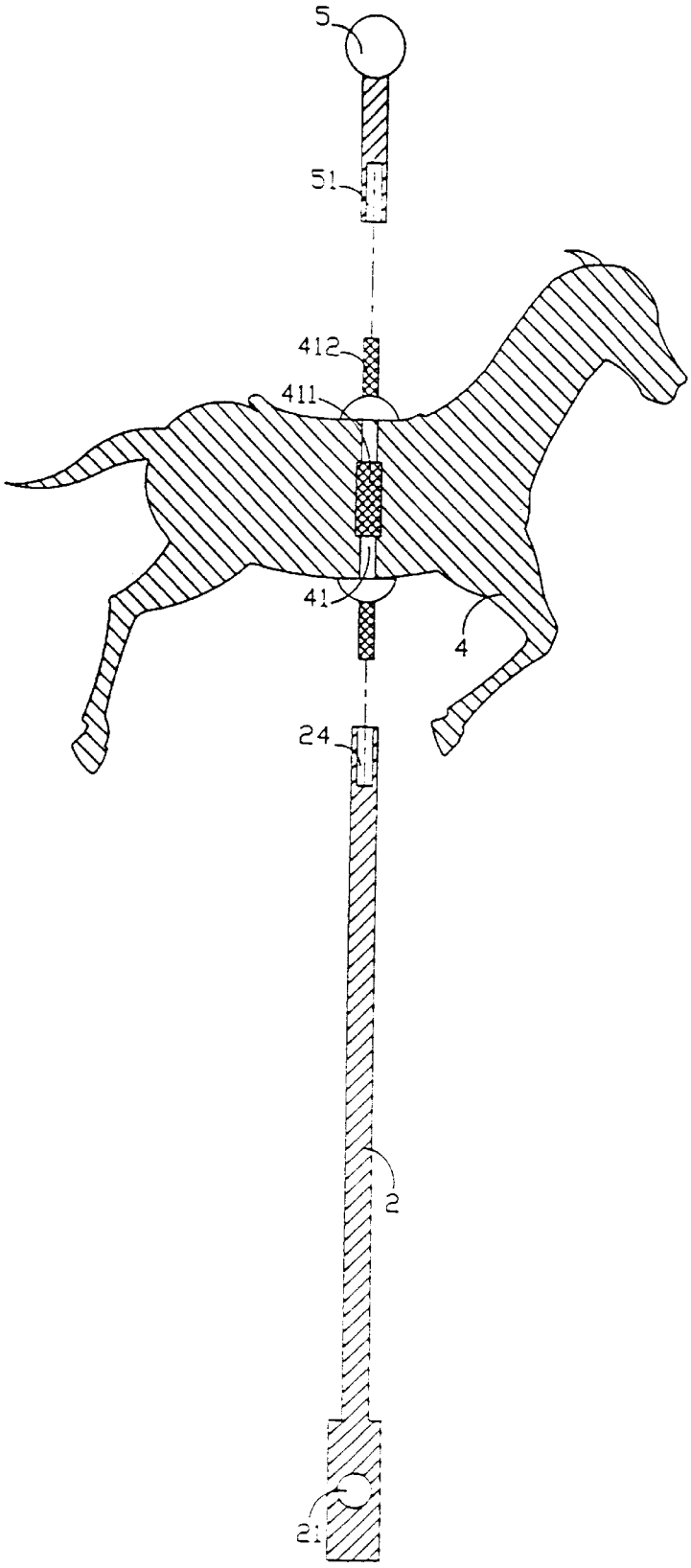
Fig. 6-B

DEVICE THAT WILL ENABLE THE DECORATION ON A MUSIC BOX TO SWAY FRONT AND BACK WHILE IT MOVES UP AND DOWN

BACKGROUND OF THE INVENTION

The present invention relates to a device that will enable the decoration on a music box to sway front and back while it moves up and down, particularly to a device that will enable the decoration on a music box to sway front and back simultaneously while it keeps moving up and down.

Conventionally, a decoration on a music will move in one of such ways as up and down, front and back, rotation on its axis, or in circles; the U.S. Pat. No. 5,640,791 relates to a mechanism wherein the decoration on a music box that will not only rotate, but will also move up and down, but it is not applicable to make the decoration to sway front and back, since the lift rod in its mechanism is fixed by a guide plate on a revolving disc, so the decoration or wooden horse rotate around a shaft rod, in case a moving shaft is to be added to each decoration or wooden horse, it will not only sophisticate the construction, but will cause significant cost increase, and the energy consumed in each operation shall require a larger battery box and a more powerful driving motor, as a result, its fundamental restrictions prevent it from front-and-back swaying effect, and the movement of the decoration appears less than realistic.

In view of such shortcomings and based on many years of experiences in the production and designs of products related to toys and music box gifts, the inventor has devoted in the research and improvement and has finally come up with a device that will enable the decoration on a music box to simultaneously sway front and back while it moves up and down, so that the movement of the decoration item or wooden horse on said music box will be more realistic, and hence such a mechanism is filed for the application of a patent right. Your favorable shall be appreciated.

SUMMARY OF THE INVENTION

The primary objective of the present invention is: the design of a device that will enable the decoration on a music box to sway front and back while it moves up and down, so the movement of the decoration on the music box will appear more realistic.

Another objective of the invention is: the design of a motor controlling the gear set, so designed that the decoration on a music box will sway to the front and back while it moves up and down.

The invention comprises mainly a first motor that drives the music wheel and cause the spring plates on the base to produce music, a second motor driving a gear set involving various gears, a propping post and a ball collar; the driving wheel rotating rod in the gear set being connected to two driving wheels, each of the two driving wheels being joined with the driving rod to a propping post, the ball collar being pierced by the propping post being mounted in the recess of the ring collar, and the ring cover fixing the ball collar in tile through hole in the ring collar; so when the second motor drives the gears and the driving wheel to turn, the propping post moves up and down in the through hole with the ball collar, and with tile feature of the ball collar swaying front and back around tile center of the ball collar support post in the ring collar, the decoration item on the music box will simultaneously sway to the front and back.

To enable your detailed understanding of the main technological contents of the invention, the following drawings are described in details:

BRIEF DESCRIPTION OF DRAWINGS

FIG. 3-A is an illustration of the invention in action (1).

FIG. 3-B is another illustration of the invention in action (2).

FIG. 4-A is an illustration (1) of the installation of the ball collar in the invention.

FIG. 4-B is an illustration (2) of the installation of the ball collar in the invention.

FIG. 6-A is an embodiment (2) of the connection between the decoration and the propping post in the invention.

FIG. 6-B is an embodiment (2) of the connection between the decoration and the propping post in the invention.

BRIEF DESCRIPTION OF NUMERALS

| | | | |
|---|---|---|---|
| 1 | base | 11 | first motor |
| 111 | music wheel | 112 | spring plate |
| 12 | battery box | 13 | second motor |
| 131 | gear set | 132 | driving wheel |
| 1321 | driving lever | 322 | driving wheel rotating rod |
| 14 | connecting rod | 141 | activating rod |
| 142 | connecting rod support post | 143 | carrier |
| 1431 | connecting rod support post recess | 2 | propping post |
| 21 | driving rod hole | 22 | ball collar |
| 221 | support post | 23 | top embossing |
| 24 | decoration fixing hole | 3 | top cover |
| 31 | ring collar | 311 | recess |
| 312 | through hole | 32 | ring cover |
| 4 | decoration 1 | 41 | connecting rod |
| 441 | central embossing | 412 | extended embossing |
| 5 | propping post head decoration | 5 | propping post head decoration fixing hole |
| 6 | decoration 2 | | |

DETAILED DESCRIPTION OF PREFERRED EMBODIMENT

Figure 1:
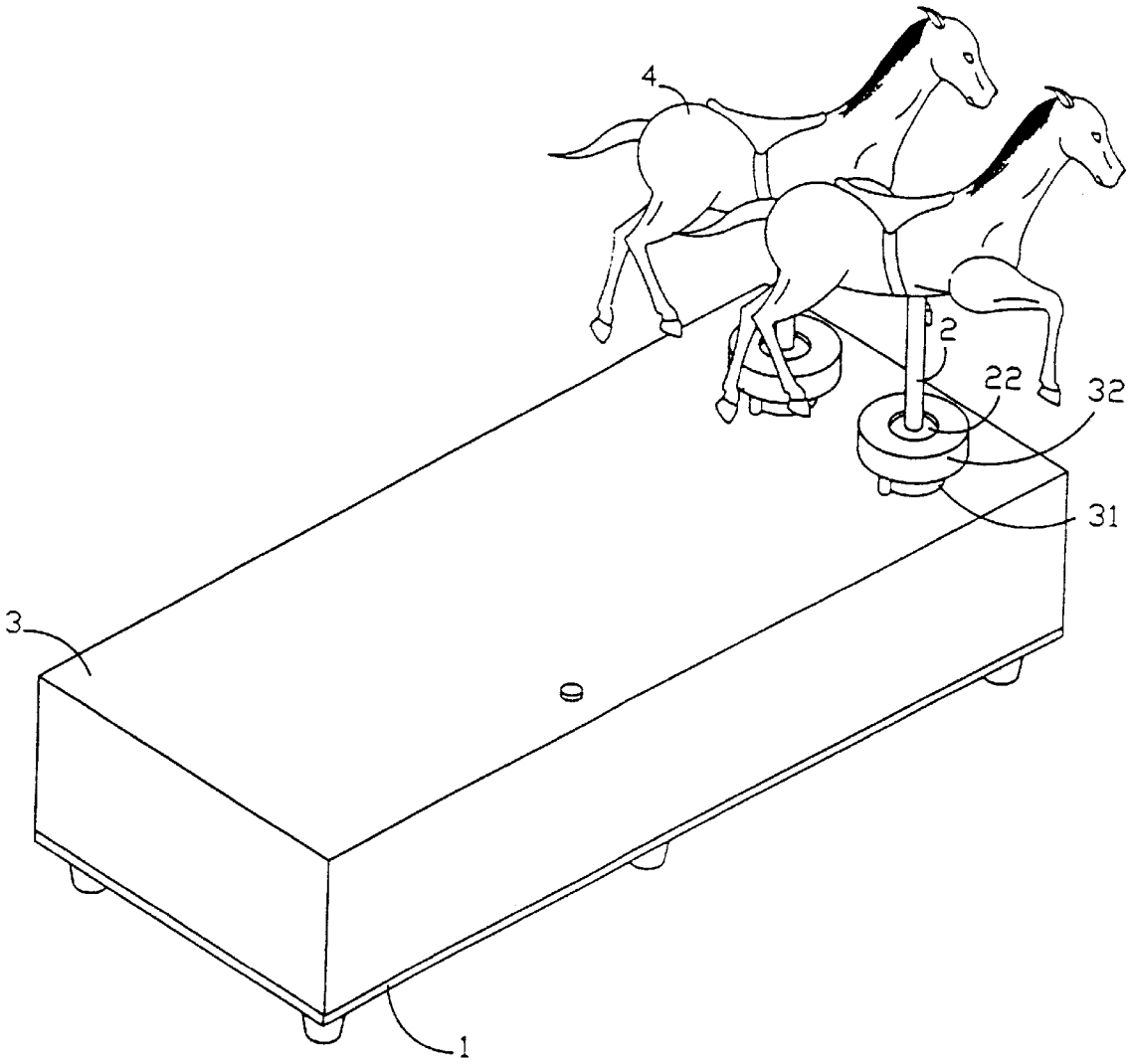
FIG. 1 is a perspective outside view of the invention.
Figure 2:
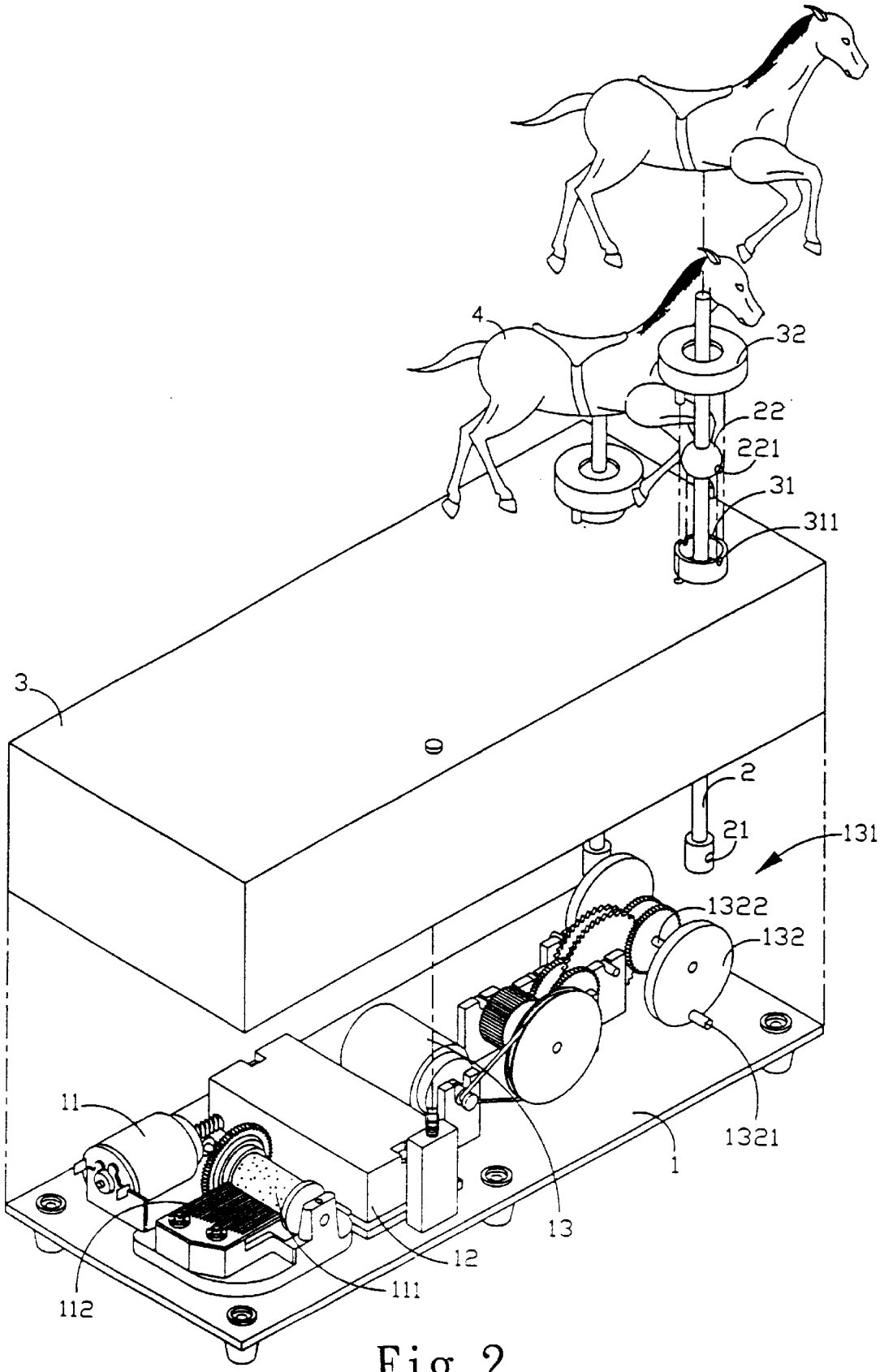
FIG. 2 is a perspective inside view of the invention.

As illustrated in FIGS. 1 and 2, the prevent invention comprise a base (1), a propping post (2) and a top cover (3); wherein on the base (1) is a first motor (11) which drives the music wheel (112) to rotate with the power supplied by a battery box (12), whereby music will be produced by the spring plates (113) when they are moving with the rotation of the music wheel (112), meanwhile the power of the battery box (12) also activates the second motor (13) to drive the gear set (131), and when the gear set (131) is operating, the driving wheel (132) that is eccentrically joined to the driving wheel rotating rod (1322) of the gear set (131) is also rotated; whereby the propping post (2) joined with a driving rod (1321) in the driving lever hole (21) is also rotating continuously with the driving wheel (132).

As illustrated in FIGS. 3-A and 3-B, the ball collar (22) inside the ring collar (31) and the ring cap (32) on the top cover (3) will sway to the front and rear with the support post (221) in the recess (311) of the ring collar (31), so when the propping post (2) is rotating continuously with the driving wheel (132), the propping post (2) moves up and down partically in the ball collar (22) so a decoration 1 (4) also rises and lowers; since the driving lever (1321) is eccentrically mounted on the driving wheel rotating rod (1421) of the gear set (131), the driving lever (1321) will provide the energy for the up-and-down movement of the propping post (2), and will also apply force so the propping post (2) will sway to the front and rear, while the ball collar (22) swaying to the front and rear inside the ring collar (2) will serve as the support for the front-and-back swaying of the propping post (2) inside the through hole (33), so that the driving lever hole (21) of the propping post (2) will rotate with the driving lever (1321) of the driving wheel (132).

As illustrated in FIGS. 4-A and 4-B, the ball collar (22) has its support post (221) mounted in the recess (311) on the ring collar (31), on its top is a ring cover (32), so that the ball collar (22) may sway to the front and rear on the support post (221) as a pivot, while the support post (221) will not escape the recess (311), so when the driving wheel (132) drives the propping post (2) to sway to the front and rear, the propping post (2) in the ball collar (22) will sway to the front and rear on the support post (221) as a pivot. Thus the prevent invention will be able to achieve the objectives of the invention—designing a device that will enable the decoration on a music box to sway to the front and rear synchronously while it is rising and falling.

Figure 5:
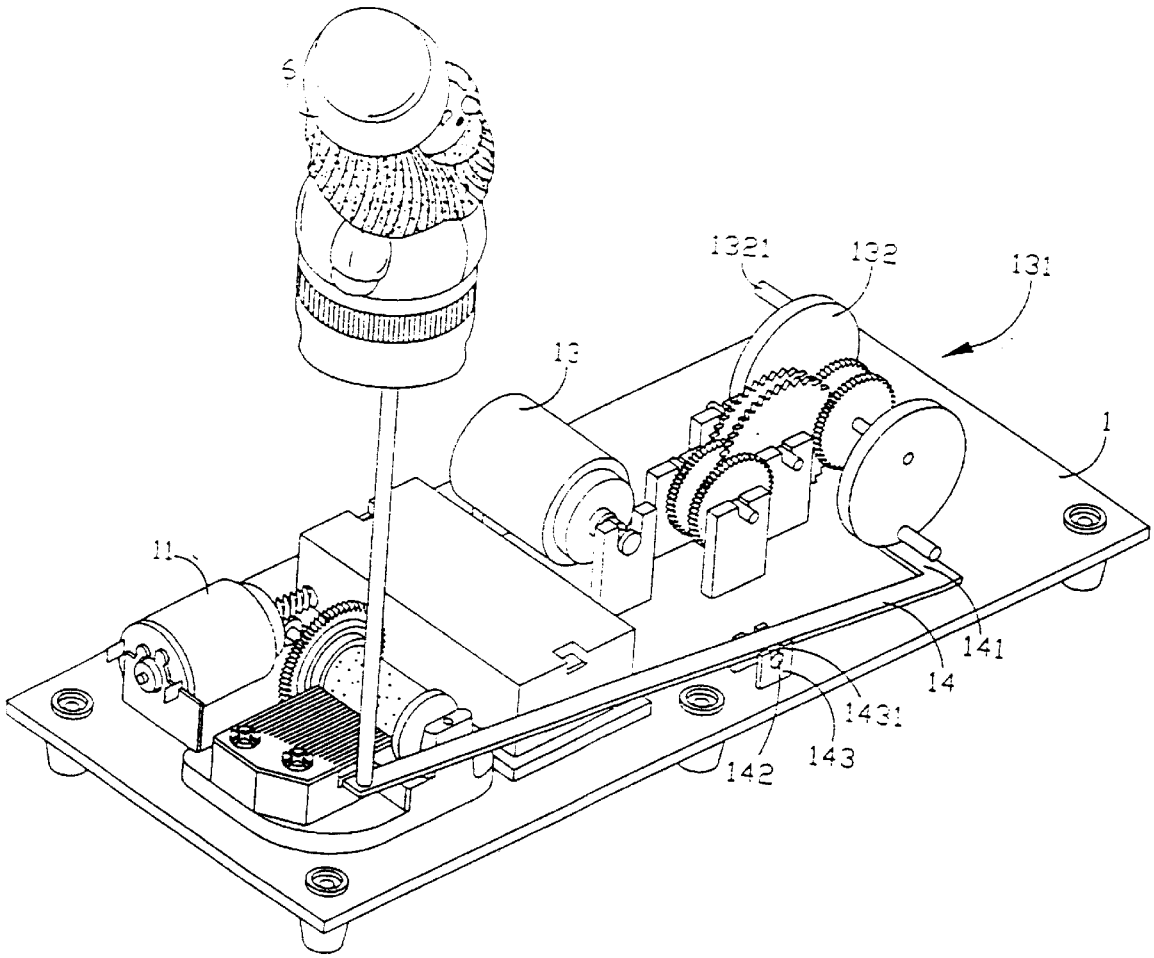
FIG. 5 is an extended embodiment of the invention.

As illustrated in FIG. 5, since the driving wheel (132) is eccentrically joined to the driving wheel rotating rod (1322), the driving wheel (132) serves as a type of cam, so when the driving wheel (132) is turning, the changes resulting on its circumference will enable one or more decorations (2) to have reciprocal movement in at least one direction. One simple example of up-and-down vertical movement of the invention is cited below.

A connecting rod (14) involving an activating rod (141) and a connecting rod supporting post (142), the connecting rod supporting post (142) is mounted on the connecting rod supporting post recess (1421) on the carrier (143), and the activating rod (141) is resting tightly below the driving wheel (132) on the principle of moment of force; when the driving wheel (132) rotates eccentrically on the axis of the driving wheel rotating rod (1322), the changing distances from the rim to the center of the driving wheel (132) will drive the activating rod (141) that is resting against the driving wheel to move up and down vertically, therefore the decoration 2 (6) the connecting rod (14) will move up and down in a vertical direction.

As illustrated in FIG. 6-A, at the top end of the propping post (2) that is inserted to the center of the decoration 2 (4) is a top embossing (23), the embossing involves the technology to produce ribbed effects that are crossed on the surface of an object, so when the liquid material (such as plastic or light metal) on the decoration 1 (4) covering the top embossing (23) of the propping post (2) is cooled, the decoration 1 (4) will be in tight contact with the propping post (2), and the cooled decoration 1 (4) will tightly grasp the top embossing (23) on the propping post (2), its resistance against the separation of the two is stronger than that on the other parts without the embossing process on the propping post (2), therefore, it will be able to prevent the decoration 1 (4) from being loosening due to outside forces.

As illustrated in FIG. 6-B, the invention may involve a type of separable and replaceable decoration 1 (4), at the center of said decoration 1 (4) is a connecting rod (41), said connecting rod (41) involves a central embossing (411) and one or two extended embossing (412) portions, with the extended embossing (412) portions being squeezed in the decoration fixing hole (24) at the top of the propping post (2), in case of another extended embossing (412), the decoration fixing hole (51) on top of the propping post will fix the propping post head decoration (5) into it, thus the propping post (2), the decoration 1 (4) and the propping post head decoration (5) will be securely fixed.

Summing up, the prevent invention is a creation that will be able to achieve the objectives of the invention, applicable and industrially utilizable, and is never publicly displayed or exhibited before the subject application, so with its qualifications for a patent right, this application is filed in accordance with the Patent Law to protect the inventor's rights and interests. Your favorable consideration shall be appreciated.

It is declared hereby that the above description, covering only the preferred embodiment of the subject matter, should not be based to limit or restrict the subject claim, and that all equivalent structural and/or configurational variations and/or modifications easily conceivable to anyone skilled in the subject art, and deriving from the subject description with drawings herein shall reasonably be included in the intent of the subject claim.

What is claimed is:

1. A device to enable a decoration on a music box to sway front and back while it moves up and down, comprising:

a base, a music wheel mounted on said base, a set of spring plates, a first motor, a second motor, a gear set driven by said second motor, at least one mounting post that passes through a top cover, a through hole of a back collar, a ring collar, and a ring cover, said decoration being affixed to an upper end of said mounting post; wherein at least one driving wheel is connected to a driving wheel rotating rod of said gear set, and a driving lever is connected to said driving wheel, an end of said driving lever being received in a driving lever hole of said mounting post, and said ball collar is slidably secured to said mounting post, and said ball collar is rotatably mounted in a recess in said ring collar, said ring cover covering said ball collar and fixing said ball collar in said ring collar; so that when said at least one driving wheel rotates, said mounting post moves up and down in said through hole of said ball collar, and said ball collar rotates front and back, thereby causing said decoration on said music box to sway front and back while said decoration simultaneously moves up and down.

2. The device that will enable the decoration on a music box to sway front and back while it moves up and down as recited in claim 1, wherein:

said driving wheel is eccentrically connected to said gear set.

3. The device that will enable the decoration on a music box to sway front and back while it moves up and down, as recited in claim 2, wherein:

said decoration on said mounting post moves when said at least one driving wheel rotates eccentrically, rotation of said driving wheel causing said driving lever to move said mounting post.

4. The device that will enable the decoration on a music box to sway front and back while it moves up and down, as recited in claim 1, wherein:

said upper end of said mounting post comprises embossing to avoid loosening of said decoration.

5. The device that will enable the decoration on a music box to sway front and back while it moves up and down, as recited in claim 1, wherein:

said decoration comprises central embossing which secures a connecting rod in an interior of said decoration.

6. The device that will enable the decoration on a music box to sway front and back while it moves up and down, as recited in claim 5, wherein:

said connecting rod comprises two extended embossing portions, a first one of said extended embossing portions being received in a decoration fixing hole in said upper end of said mounting post, and a second one of said extended embossing portions being received in a head decoration fixing hole of a head decoration.

* * * * *